US006969270B2

(12) United States Patent
Renfro et al.

(10) Patent No.: US 6,969,270 B2
(45) Date of Patent: Nov. 29, 2005

(54) INTEGRATED SOCKET AND CABLE CONNECTOR

(75) Inventors: Tim A. Renfro, Mesa, AZ (US); Jiteender P. Manik, Chandler, AZ (US); Michael Li, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/609,231

(22) Filed: Jun. 26, 2003

(65) Prior Publication Data

US 2004/0266226 A1 Dec. 30, 2004

(51) Int. Cl.[7] ..... H01R 12/24; H01R 13/625
(52) U.S. Cl. ..... 439/342; 439/494; 439/60
(58) Field of Search ..... 439/70, 342, 259, 439/68, 69, 266, 260, 495, 492, 494, 496, 439/525

(56) References Cited

U.S. PATENT DOCUMENTS 4,173,388 A * 11/1979 Brandeau ..... 439/442
4,257,028 A * 3/1981 Narozny et al. ..... 439/494
4,814,857 A 3/1989 Werbizky et al.
5,694,297 A 12/1997 Smith et al.
5,859,538 A * 1/1999 Self ..... 324/755
5,892,275 A 4/1999 McMahon et al.
6,074,221 A * 6/2000 Kajiwara ..... 439/495
6,204,864 B1 3/2001 Chee
6,347,946 B1 * 2/2002 Trobough et al. ..... 439/70
6,359,783 B1 * 3/2002 Noble ..... 439/487
6,606,679 B2 * 8/2003 Solomon et al. ..... 710/314

FOREIGN PATENT DOCUMENTS

EP 0 878 033 A1 11/1998
WO WO 97/14195 4/1997

OTHER PUBLICATIONS

PCT Search Report, PCT/US2004/018167, Apr. 4, 2005, 6 pages.
PCT Written Opinion, PCT/US2004/018167, Apr. 4, 2005, 8 pages.

* cited by examiner

*Primary Examiner*—Briggitte R. Hammond
(74) *Attorney, Agent, or Firm*—Blakely, Sokoloff, Taylor & Zafman LLP

(57) ABSTRACT

According to one embodiment of the present invention, an integrated socket is disclosed. The socket includes a socket grid to receive one or more pins from a component, a frame coupled to the socket grid to provide structural support, and a cable receptacle integrated into the socket to receive a cable.

27 Claims, 7 Drawing Sheets

(A)
(B)
Actuator lever 606
positions full open and
mid rotation
606
602
602
610
608
506

602
602
604
604
310
506
Actuator lever 606
Closed position 506
506
802
802
606
606
Actuator lever
Closed position
606
506

606
310
506

INTEGRATED SOCKET AND CABLE CONNECTOR

COPYRIGHT NOTICE

Contained herein is material that is subject to copyright protection. The copyright owner has no objection to the facsimile reproduction of the patent disclosure by any person, as it appears in the Patent and Trademark Office patent files or records, but otherwise reserves all rights to the copyright whatsoever.

FIELD OF THE INVENTION

The present invention generally relates to the field of electrical connectors. More particularly, an embodiment of the present invention relates to an integrated socket and cable connector.

BACKGROUND

As the speed and complexity of processors and other integrated circuit components has increased, the need for high-speed input/output I/O and clean power delivery has also increased. Conventional packaging technologies are running into physical limitations, making them unable to meet all the requirements.

Moreover, due to the increasing trends of higher current and high I/O count, using the present techniques drives a substantial increase in pin count, hence an increase in body size and package cost. Also, most central processing units (CPU) currently have about 2.5–6.2 square inches required connector footprint on the CPU substrate, which is limiting and expensive.

One current solution is to have multiple connectors in the logic and power circuitry. This solution, however, introduces a high level of inductance and resistance, which in turn can degrade the signals and lose power.

FIGS. 1*a*–1*c* illustrate the state of the current art. FIG. 1*a* shows a typical land grid array (LGA) socket where both the power and signal contacts areas are homogeneous in contact design and placement. The socket of FIG. 1*a* includes formed metal contacts 102 to engage a component and a frame 104. FIG. 1*b* shows a cross-sectional view of the socket shown in FIG. 1*a*.

FIG. 1*c* shows a top view of a standard pin grid array (PGA) zero insertion force (ZIF) socket. The socket of FIG. 1*c* includes an actuation lever 106 to lock an inserted device in place and a socket grid 108 to receive pins from the inserted component.

Generally, current technology has all I/O and power going through the pins or pads on the CPU package. In some high-end implementatious, such as in server computers, an additional power connector on the edge of the CPU substrate may be utilized. This approach also raises inductance, which in turn can degrade the signals significantly.

BRIEF DESCRIPTION OF THE DRAWINGS

The invention is illustrated by way of example and not limitation in the figures of the accompanying drawings, in which like references indicate similar or identical elements, and in which.

DETAILED DESCRIPTION

In the following detailed description of the present invention numerous specific details are set forth in order to provide a thorough understanding of the present invention. However, it will be apparent to one skilled in the art that the present invention may be practiced without these specific details. In other instances, well-known structures and devices are shown in block diagram form, rather than in detail, in order to avoid obscuring the present invention.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

Figure 1A:
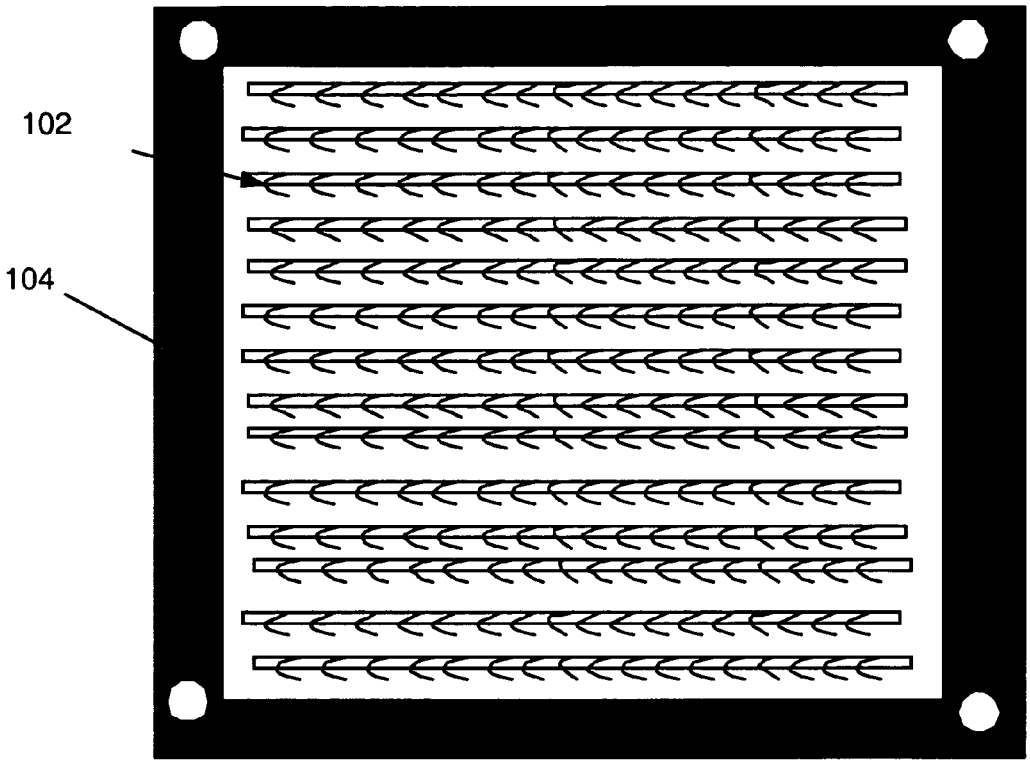
Fig. 1a Prior Art
FIGS. 1*a*–1*c* illustrate the state of the current art.
Figure 1B:
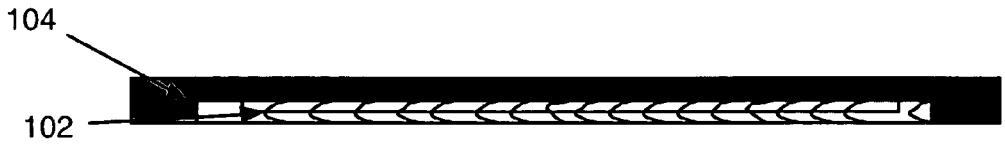
Fig. 1b Prior Art
Figure 1C:
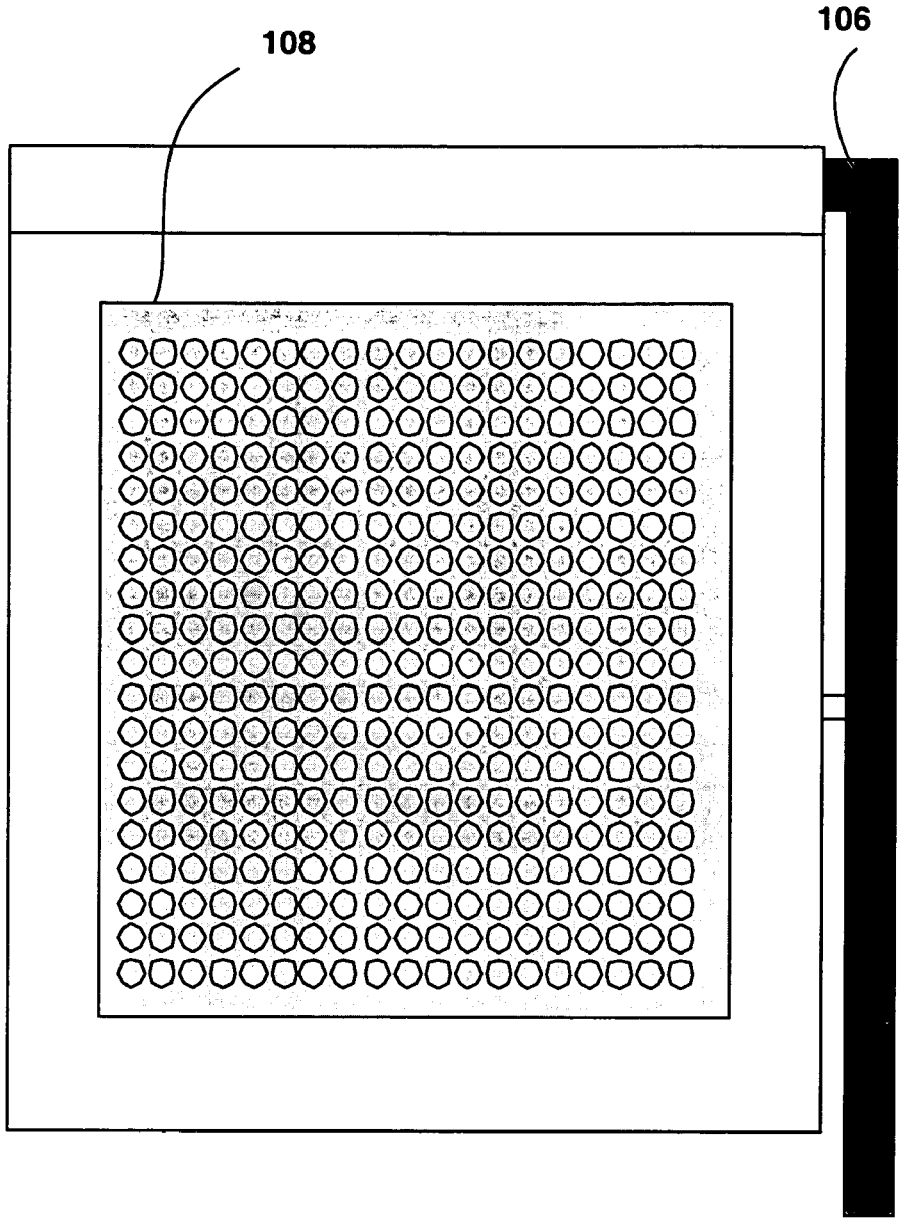
Fig. 1c Prior Art
Figure 2:
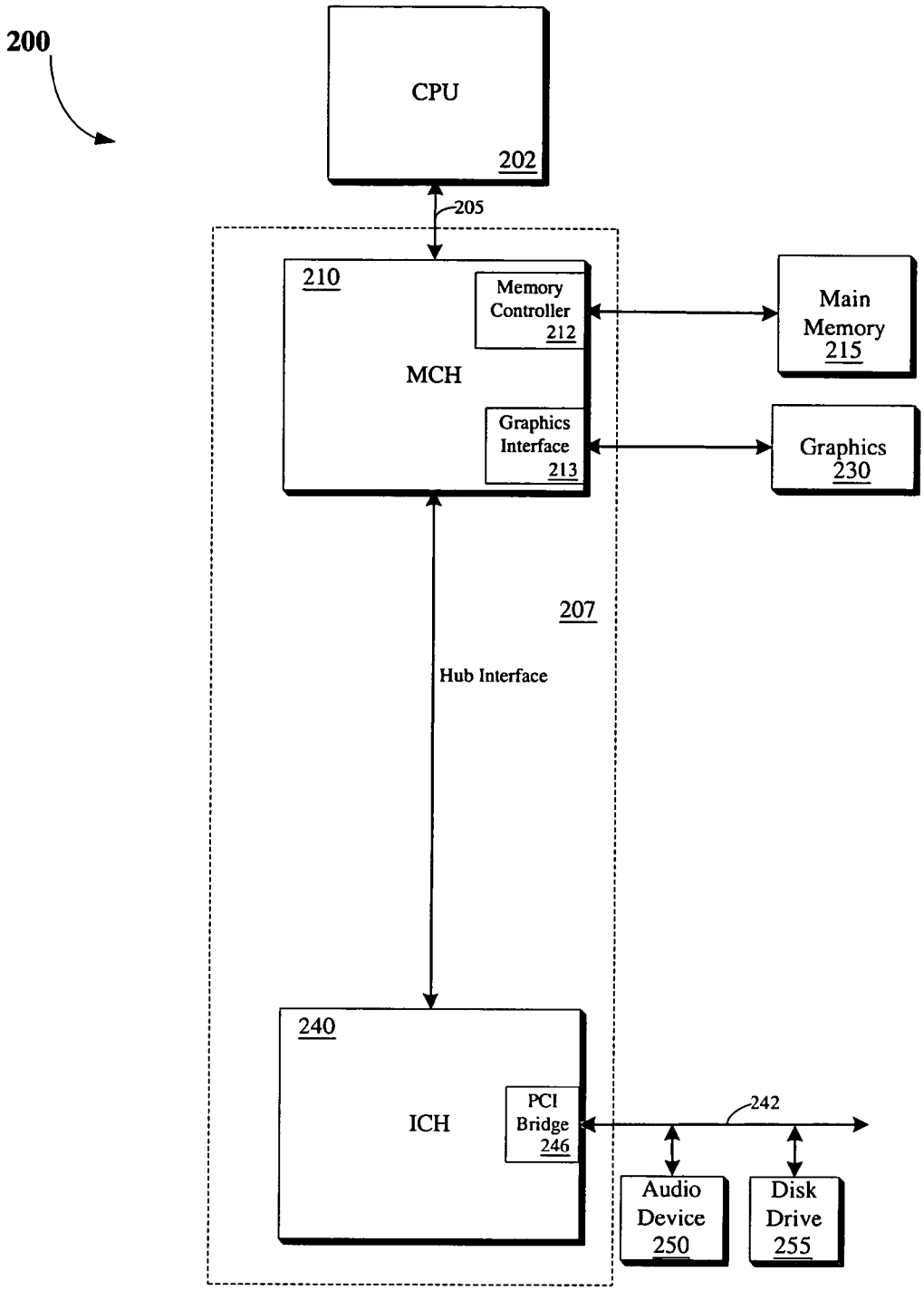
FIG. 2 illustrates an exemplary block diagram of a computer system 200 in accordance with an embodiment of the present invention.

FIG. 2 illustrates an exemplary block diagram of a computer system 200 in accordance with an embodiment of the present invention. The computer system 200 includes a central processing unit (CPU) 202 coupled to a bus 205. In one embodiment, the CPU 202 is a processor in the Pentium® family of processors including the Pentium® II processor family, Pentium® III processors, Pentium® 4 processors available from Intel Corporation of Santa Clara, Calif. Alternatively, other CPUs may be used, such as Intel's XScale processor, Intel's Banias Processors, ARM processors available from ARM Ltd. of Cambridge, the United Kingdom, or OMAP processor (an enhanced ARM-based processor) available from Texas Instruments, Inc., of Dallas, Tex.

A chipset 207 is also coupled to the bus 205. The chipset 207 includes a memory control hub (MCH) 210. The MCH 210 may include a memory controller 212 that is coupled to a main system memory 215. Main system memory 215 stores data and sequences of instructions that are executed by the CPU 202 or any other device included in the system 200. In one embodiment, main system memory 215 includes dynamic random access memory (DRAM); however, main system memory 215 may be implemented using other memory types. Additional devices may also be coupled to the bus 205, such as multiple CPUs and/or multiple system memories.

The MCH 210 may also include a graphics interface 213 coupled to a graphics accelerator 230. In one embodiment, graphics interface 213 is coupled to graphics accelerator 230 via an accelerated graphics port (AGP) that operates according to an AGP Specification Revision 2.0 interface developed by Intel Corporation of Santa Clara, Calif.

In addition, the hub interface couples the MCH 210 to an input/output control hub (ICH) 240 via a hub interface. The ICH 240 provides an interface to input/output (I/O) devices within the computer system 200. The ICH 240 may be coupled to a Peripheral Component Interconnect (PCI) bus adhering to a Specification Revision 2.1 bus developed by the PCI Special Interest Group of Portland, Oreg. Thus, the ICH 240 includes a PCI bridge 246 that provides an interface to a PCI bus 242. The PCI bridge 246 provides a data path between the CPU 202 and peripheral devices.

The PCI bus 242 includes an audio device 250 and a disk drive 255. However, one of ordinary skill in the art will appreciate that other devices may be coupled to the PCI bus 242. In addition, one of ordinary skill in the art will recognize that the CPU 202 and MCH 210 could be combined to form a single chip. Furthermore, graphics accelerator 230 may be included within MCH 210 in other embodiments.

In addition, other peripherals may also be coupled to the ICH 240 in various embodiments. For example, such peripherals may include integrated drive electronics (IDE) or small computer system interface (SCSI) hard drive(s), universal serial bus (USB) port(s), a keyboard, a mouse, parallel port(s), serial port(s), floppy disk drive(s), digital output support (e.g., digital video interface (DVI)), and the like. Moreover, the computer system 200 is envisioned to receive electrical power from one or more of the following sources for its operation: a battery, alternating current (AC) outlet (e.g., through a transformer and/or adaptor), automotive power supplies, airplane power supplies, and the like.

Figure 3:
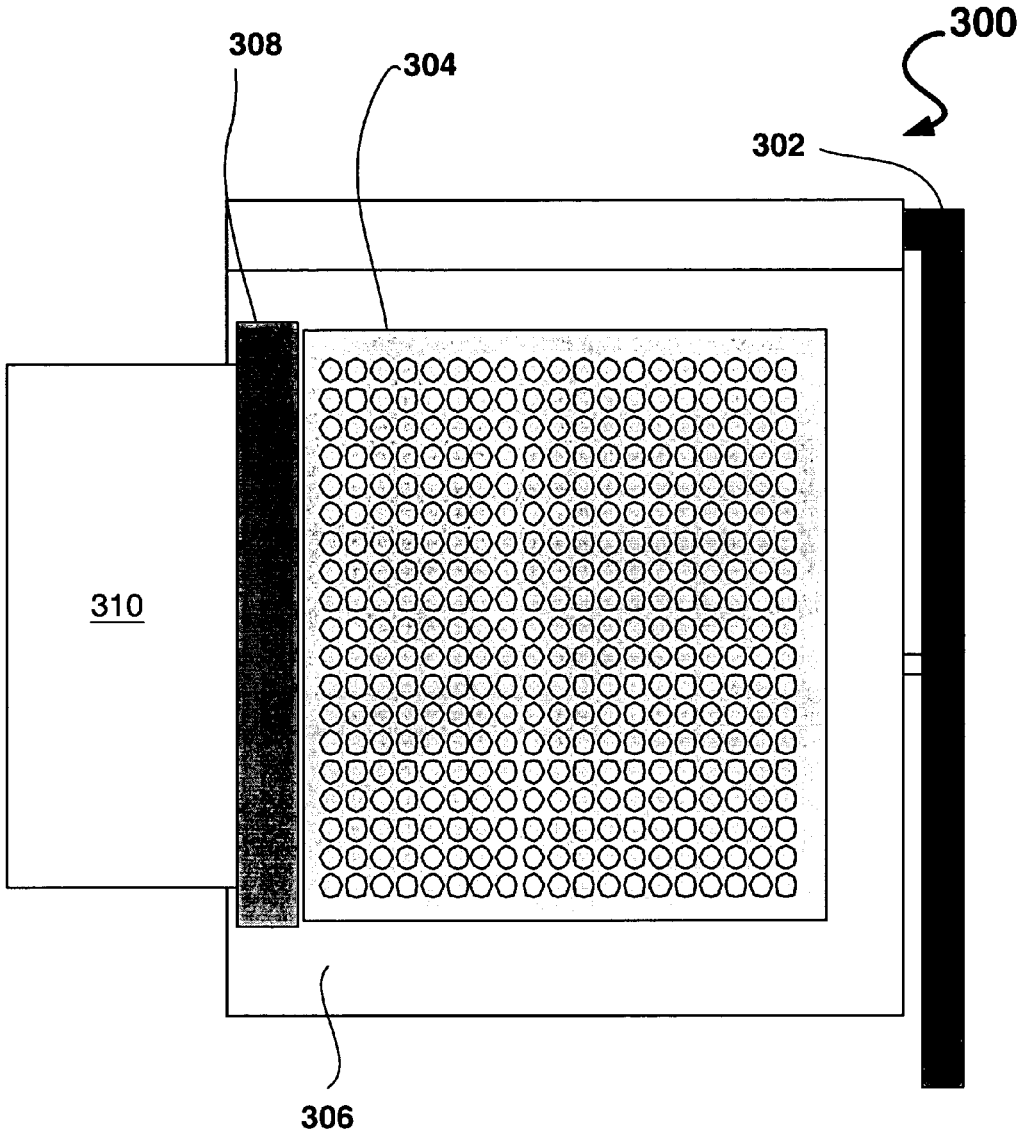
FIG. 3 illustrates an exemplary top view of a socket 300 in accordance with an embodiment of the present invention.

FIG. 3 illustrates an exemplary top view of a socket 300 in accordance with an embodiment of the present invention. The socket 300 in includes an actuation lever 302 (e.g., to lock down or hold in place an inserted component), a socket grid 304 (e.g., to receive pins of the inserted component), a socket frame 306 (e.g., to provide structural rigidity for the socket 300), a cable connector 308 (e.g., to receive a flex cable or other types of cables), and a cable 310.

In an embodiment of the present invention, the cable 310 may be any type of cable inch as a ribbon cable, flex cable, flat cable, combinations thereof, and the like. The signals (such as I/O signals) routed through the cable may then be coupled through the cable connect to the socket 300. These signals may be coupled to individual receptacles within the socket grid 304 and/or coupled to one or more of the power/ground planes. In one embodiment of the present invention, the power/ground plane may be provided through the socket 300 (e.g., through its frame 306). Moreover, the signals and/or power/ground may be coupled to the motherboard through the socket 300 (e.g., though its frame 306).

In another embodiment of the present invention, the socket 300 provides a solution that can be used with the current sockets, for example, by providing the cable connector 308 on the socket 300. In such an embodiment of the present invention, an additional substrate area of a CPU and, or the chip, being plugged into the socket 300 (e.g., about 0.25 square inch or more) may be required.

Figure 4:
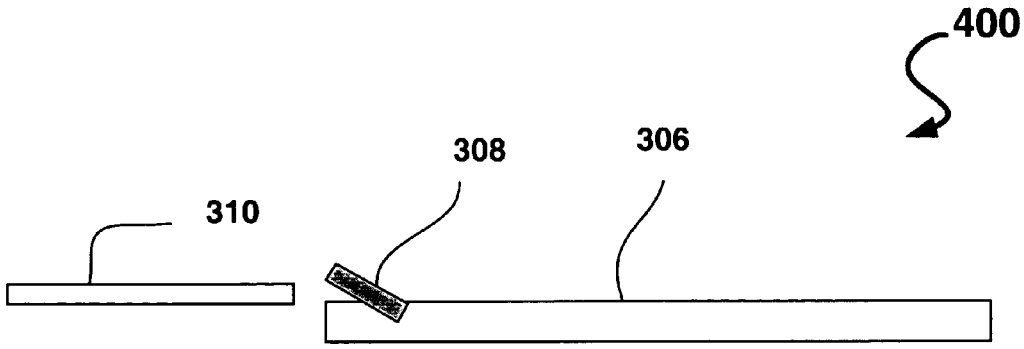
FIG. 4 illustrates an exemplary side view of a socket insertion technique 400 in accordance with an embodiment of the present invention.

FIG. 4 illustrates an exemplary side view of a socket insertion technique 400 in accordance with an embodiment of the present invention. In one embodiment of the present invention, the socket insertion technique 400 may be applied to the socket 300 of FIG. 3. The socket insertion technique 400 illustrates the cable 310 being inserted into the cable connector 308 (which is in turn pivotally attached to the socket frame 306. In one embodiment of the present invention, once the cable 310 is fully inserted into the cable connector 308, the cable connector 308 (or its latch) is pivoted in a downwardly direction to engage and/or lock in the cable 301. It is envisioned that the cable 310 may establish electrical contact with flex bumps present on and/or within the socket frame 306 in accordance with an embodiment of the present invention.

In a further embodiment of the present invention, the socket frame 306 (e.g., the base and cover above) are formed to allow for a section with independent contacts and/or a closeable latching lid that holds the cable against the contacts (e.g., 308). These contacts may be attached to signal lines and/or power/ground layer within the socket 300 that is/are connected to socket contacts and/or the motherboard. In yet another embodiment of the present invention, the power/ground layer can be made of flex, stamped metal, plated plastic, and/or combinations thereof in the socket body.

Figure 5:
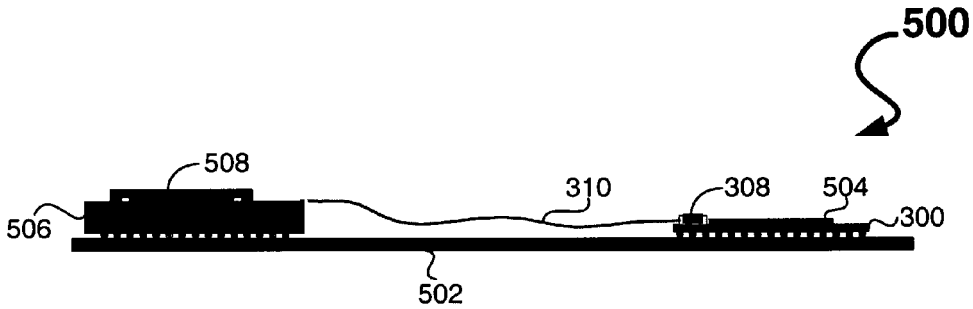
FIG. 5 illustrates an exemplary side view of a chip-to-chip coupling system 500 in accordance with an embodiment of the present invention.

FIG. 5 illustrates an exemplary side view of a chip-to-chip coupling system 500 in accordance with an embodiment of the present invention. The system 500 includes a motherboard 502, a chipset 504, an integrated socket 506, a chip 508 (such as a CPU discussed with respect to other figures herein, e.g., 202 of FIG. 2), the cable 310, the connector 308, and the socket 300. As illustrated in FIG. 5, the cable 310 may couple the chipset 504 (e.g., through the connector 308) to the integrated socket 506. In turn, the integrated socket may provide connections between the cable 310 and one or more of power/ground planes and/or signals (e.g., I/O signals) and the chip 508 and/or the motherboard 502.

In an alternate embodiment of the present invention, the integrated socket 506 provides less inductance than a socket with a connector (such as that discussed with respect FIG. 3). Additionally, the integrated socket 506 may require less substrate area when compared with the embodiment having a socket and a connector.

In a further embodiment of the present invention, the integrated socket 506 may internally route signals and/or power/ground layers to provide connections between the cable 310, the chip 508, and/or the motherboard 502.

In yet another embodiment of the present invention, an integrated socket design may be utilized for both the chip 508 and the chipset 504. Furthermore, the integrated socket design may be utilized to establish a coupling between any two or more components such as integrated circuits (ICs).

In accordance with an embodiment of the present invention, the integrated socket 508 is made through the following process:

1. mold the base and cover of the socket;
2. mold or fabricate the actuation lever (302);
3. form the contacts for the socket;
4. insert the contacts into the base of the socket; and
5. snap on the cover of the socket.

In an alternate embodiment of the present invention, the socket frame 306 and the socket grid 304 are manufactured as a single piece.

Figures 6, 7, 8:
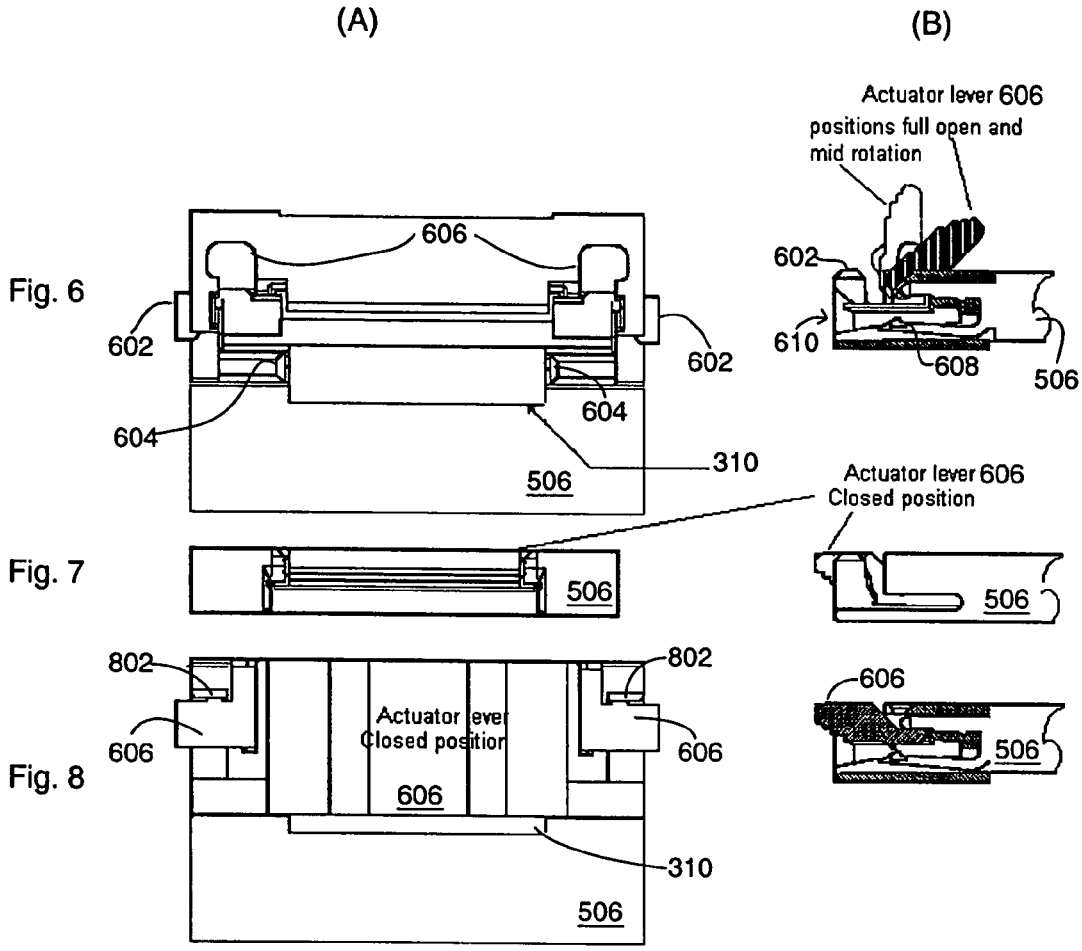
FIGS. 6A, 7A and 8A illustrate exemplary top views of an integrated socket latching mechanism in accordance with various embodiments of the present invention.
FIGS. 6B, 7B and 8B illustrate exemplary cross-sectional side views of the integrated socket latching mechanism in accordance with various embodiments of the present invention.

FIGS. 6A, 7A and 8A illustrate exemplary top views of an integrated socket latching mechanism in accordance with various embodiments of the present invention. FIGS. 6B, 7B and 8B illustrate exemplary cross-sectional side views of the integrated socket latching mechanism in accordance with various embodiments of the present invention.

FIG. 6A illustrates structural columns 602 (e.g., to provide structural support for the integrated socket) and guides 604 (e.g., to assist in guiding the engagement of the cable 310 and the integrated socket 506). FIG. 6A further illustrates an actuator lever 606 in the fully open position. In one embodiment of the present invention, the actuator lever 606 is pivotally attached to the integrated socket 506.

FIG. 6B illustrates the cross-section view of the integrated socket with the actuator lever 606 in the fully open position. FIG. 6B further illustrates contact prongs(s) 608 (e.g., to establish contact with the cable 310) and an insertion opening or cable receptacle 610 (e.g., to receive the cable 310). In one embodiment of the present invention, one or more of the contact prongs(s) 608 is spring loaded to further assist in engaging the cable 310. In a further embodiment of the present invention, one or more of the contact prongs(s) 608 may be self-piercing contact prongs to establish electrical contact with the cable 310 (whether or not the insulation of the cable 310 has been removed). In another embodiment of the present invention, the contact prongs may be utilized in the cable connector 308.

FIGS. 7A and 8A illustrate top views of the actuator lever 606 in a closed position. FIGS. 7B and 8B illustrate cross-sectional views of the actuator lever 606 in a closed position. FIG. 8A illustrates locking tabs 802 to lock in the actuator lever 606 while in the closed position. In accordance with an embodiment of the present invention, it is envisioned that the actuator lever 606 may be slideably attached to the integrated socket 506 (e.g., through sliding tabs 802).

Figure 9:
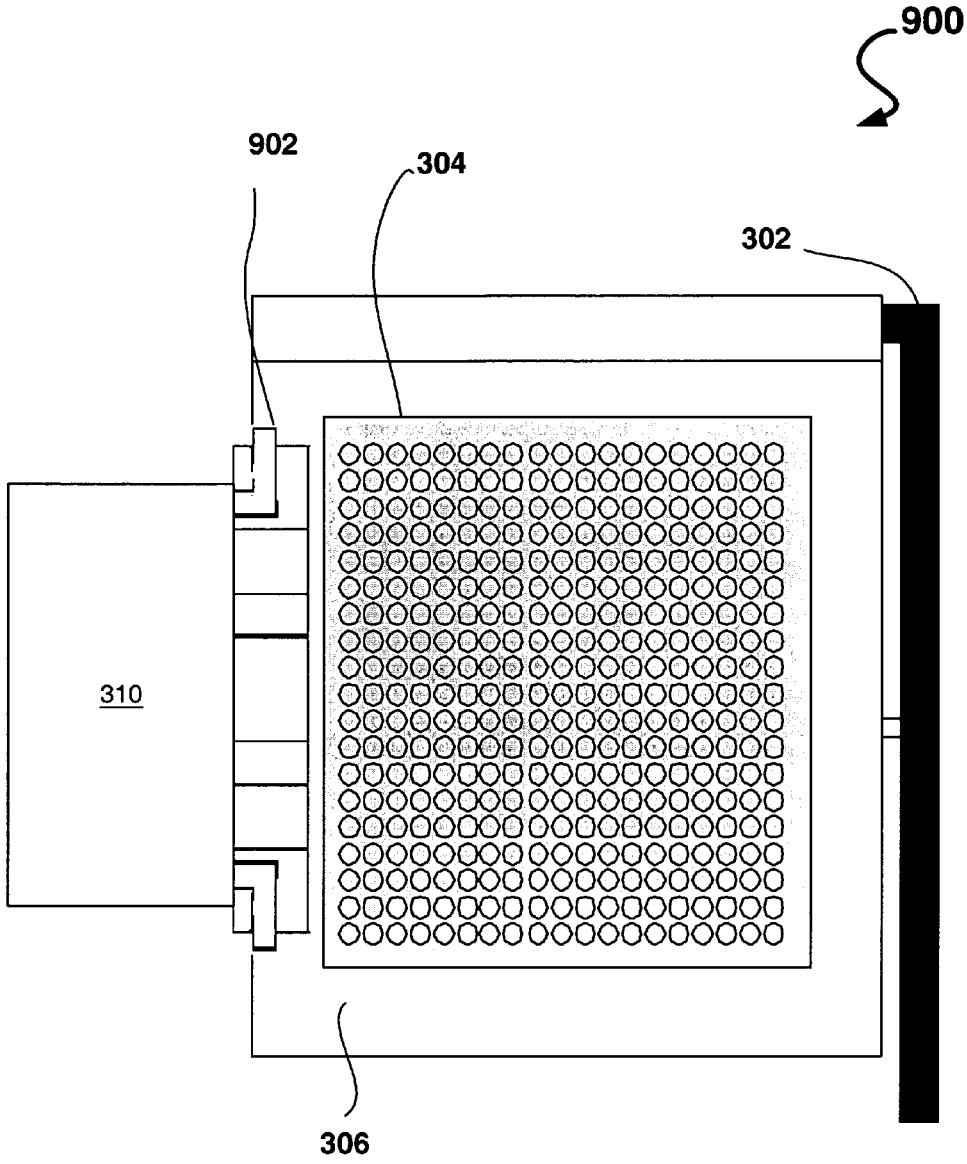
FIG. 9 illustrates an exemplary integrates socket 900 in accordance with an embodiment of the present invention.

FIG. 9 illustrates an exemplary integrated socket 900 in accordance with an embodiment of the present invention. In one embodiment of the present invention, the integrated socket 900 may have characteristics that are the same or similar to those discussed with respect to the integrated socket 506. The integrated socket 900 includes the actuation lever 302, the socket grid 304, and the socket frame 306. The integrated socket 900 may further include a cable latch or lid 902, which may snap down to connect the cable 310 to the integrated socket 900.

In one embodiment of the present invention, the integrated socket/connectors discussed herein may enable the separation of strategic I/O and/or power from the board. In another embodiment of the present invention, since flex cable may generally have much better and consistent capacitance, the techniques discussed herein may allow for cleaner signal linking to support chipsets and/or smart voltage regulators. In an alternate embodiment of the present invention, the socket may also include holes for mounting purposes (e.g., mounting on the motherboard).

In a further embodiment of the present invention, a single multipurpose connector is utilized to electrically connect components to enable transfer of power/ground and/or I/O into and out of logic circuits. In yet a further embodiment of the present invention, the integrated sockets discussed herein yield low inductance, low resistance, and low cost sockets and connector combinations that reduce part count, motherboard footprint, cross talk, and/or inductance on selected power/ground and/or I/O lines.

Whereas many alterations and modifications of the present invention will no doubt become apparent to a person of ordinary skill in the art after having read the foregoing description, it is to be understood that any particular embodiment shown and described by way of illustration is in no way intended to be considered limiting. Therefore, references to details of various embodiments are not intended to limit the scope of the claims which in themselves recite only those features regarded as essential to the invention.

What is claimed is:

1. An apparatus comprising:

a socket grid of a socket to receive pins from an integrated circuit component;

a frame of the socket coupled to the socket grid to provide structural support;

a component actuator lever coupled to the frame to hold the component in place and a cable connector integrated into the socket to receive a cable, the cable connector having guides to assist in guiding a cable into engagement with the cable connector, a set of contact prongs to establish electrical connection with a cable, and an actuator lever pivotally attached to the socket operable to retain a cable in the cable connector and to move the contact prongs into electrical connection with the cable.

2. The apparatus of claim 1 wherein at least one of the contact prongs is spring loaded to assist in engaging the cable.

3. The apparatus of claim 1 wherein at least one of the contact prongs is self-piercing to establish electrical contact with the cable.

4. The apparatus of claim 1 wherein the frame and the socket grid are manufactured as a single piece.

5. The apparatus of claim 1 wherein the cable connector comprises a latch to secure a cable in the cable connector.

6. The apparatus of claim 1 wherein signals are routed through the socket.

7. The apparatus of claim 6 wherein the routed signals are routed between the pins and the connector cable.

8. The apparatus of claim 6 wherein the routed signals are routed to a motherboard.

9. The apparatus of claim 8 wherein the signals are selected from a group comprising I/O signals, power signals, ground signals, and combinations thereof.

10. The apparatus of claim 9 wherein the power signals and the ground signals are routed through the socket to the motherboard and the I/O signals are routed through the socket to the cable connector.

11. The apparatus of claim 9 wherein the I/O signals are routed through the socket to the cable connector and are not routed to the motherboard.

12. The apparatus of claim 1 wherein the component is an integrated circuit (IC).

13. The apparatus of claim 12 wherein the IC is one of a CPU and a chipset.

14. The apparatus of claim 1 further comprising:

a central processing unit (CPU); and a memory coupled to the CPU to store data for operation by the CPU;

and wherein the integrated circuit component is the CPU.

15. The apparatus of claim 14 further including a memory control hub coupled between the memory and the CPU.

16. The apparatus of claim 1 wherein the cable connector comprises a cable receptacle.

17. The apparatus of claim 16 wherein signals are routed between the pins and the cable receptacle.

18. The apparatus of claim 17 wherein the signals comprise at least one of I/O signals, power signals, and ground signals.

19. The apparatus of claim 1 further comprising:

a motherboard;

a central processing unit (CPU), the CPU being the integrated circuit component, the pins of which are received by the socket;

a memory control hub (MCH);

an MCH socket to receive the MCH, the MCH socket having a cable connector;

a cable to interconnect the CPU socket cable connector and the MCH socket cable connector.

20. The apparatus of claim 19 wherein the cable carries I/O signals and does not carry power signals between the CPU and the MCH.

21. The apparatus of claim 19 wherein the cable comprise a computer flex cable.

22. The apparatus of claim 19 wherein the MCH socket cable connector comprises a latch to secure the cable.

23. A method of mounting an integrated circuit component comprising:

placing the integrated circuit component in a socket, the socket having a grid to receive pins and a component actuator level coupled to the frame to hold the component in place from the component; and connecting a cable to a cable connector integrated into the socket to receive the cable, the cable having connector guides to assist in guiding the cable into engagement with the cable connector, a set of contact prongs to establish electrical connection with a cable, and an actuator level pivotally attached to the socket operable to retain the cable in the cable connector, and to move the contact prongs into electrical connection with the cable the cable connector routing signals between the cable and the pins.

24. The method of claim 23 wherein connecting the cable comprises inserting a cable along the guides of the cable connector into a cable receptacle and operating the actuator lever to secure the cable.

25. The method of claim 23 further comprising:

placing a second component in a second socket, the second socket having a grid to receive pins from the second component; and connecting the cable to a second cable connector integrated into the second socket, the second cable connector routing signals between the cable and the pins of the second socket.

26. The method of claim 23 further including routing one or more signals through the socket.

27. The method of claim 26 wherein the one or more signals are power signals.

* * * * *